United States Patent [19]

Furukawa et al.

[11] Patent Number: 4,475,492

[45] Date of Patent: Oct. 9, 1984

[54] SYSTEM FOR FORCEFULLY IGNITING SPRAYED FUEL OF A DIESEL ENGINE DURING ENGINE STARTING

[75] Inventors: Junichi Furukawa, Yokohama; Yasuhiko Nakagawa, Kamakura; Meroji Nakai; Kyugo Hamai, both of Yokosuka, all of Japan

[73] Assignee: Nissan Motor Company, Limited, Yokohama, Japan

[21] Appl. No.: 420,843

[22] Filed: Sep. 21, 1982

[30] Foreign Application Priority Data

Sep. 30, 1981 [JP] Japan ..... 56-155744
Sep. 30, 1981 [JP] Japan ..... 56-155745

[51] Int. Cl.[3] ..... F02N 17/00

[52] U.S. Cl. ..... 123/179 BG; 123/179 B; 290/38 R

[58] Field of Search ..... 123/179 BG, 179 B, 143 B, 123/620, 618, 414; 290/38, 38 C, 38 D

[56] References Cited

U.S. PATENT DOCUMENTS

| | | | |
|---|---|---|---|
| 2,627,254 | 6/1947 | De Juhasz | 123/32 |
| 3,605,714 | 6/1969 | Hardin et al. | 123/148 E |
| 3,606,873 | 9/1971 | Rademacher et al. | |
| 3,866,059 | 2/1975 | Przywozny | 290/38 R |
| 3,901,201 | 8/1975 | Mizuguchi et al. | 123/414 |
| 3,982,518 | 9/1976 | Lapeyronnie | |
| 3,996,912 | 12/1976 | Dreisin et al. | |
| 4,111,173 | 9/1978 | Skinner | 123/139 |
| 4,111,178 | 9/1978 | Casey | |
| 4,178,893 | 12/1979 | Aoki | 123/179 BG |
| 4,228,778 | 10/1980 | Rabus et al. | 123/605 |
| 4,301,782 | 11/1981 | Wainwright | 123/620 |
| 4,328,771 | 5/1982 | Kawai et al. | 123/179 BG |
| 4,366,801 | 1/1983 | Endo et al. | 123/620 |
| 4,369,758 | 1/1983 | Endo | 123/620 |
| 4,370,964 | 2/1983 | Muranaka et al. | 123/414 |
| 4,398,526 | 8/1983 | Hamai et al. | 123/143 B |
| 4,445,491 | 5/1984 | Ishikawa et al. | 123/605 |

FOREIGN PATENT DOCUMENTS

| | | |
|---|---|---|
| 1804383 | 7/1970 | Fed. Rep. of Germany . |
| 2436265 | 4/1980 | France . |
| 410752 | 5/1934 | United Kingdom . |
| 479904 | 2/1938 | United Kingdom . |
| 773899 | 5/1957 | United Kingdom . |
| 2031067 | 4/1980 | United Kingdom . |
| 2039995 | 8/1980 | United Kingdom . |
| 2081810 | 2/1982 | United Kingdom . |

*Primary Examiner*—Parshotam S. Lall
*Attorney, Agent, or Firm*—Schwartz, Jeffery, Schwaab, Mack, Blumenthal & Koch

[57] ABSTRACT

A system for forcefully igniting a spray of fuel injected into combustion chambers of a diesel engine during engine starting, in place of a conventional glow plug preheating system. The system comprises a plurality of spark plugs located within the respective combustion chambers of the diesel engine and an ignition means for sequentially igniting each of the spark plugs. The system is operated simultaneously with an engine starter motor and at least until the engine has achieved a spontaneous ignition state or most preferably until a fixed interval of time after the engine has achieved the spontaneous ignition state. Detection of the spontaneous ignition state is based on (a) combustion pressure; (b) engine speed; (c) oxygen concentration; (d) engine starter motor actuation (e) exhaust gas temperature; or (f) engine cooling water temperature.

14 Claims, 9 Drawing Figures

FJ
26
25
27
SC
HL
CW
P1a
P1
FIRST CYLINDER(#1)
P2 (#3)
P3 (#4)
P4 (#2)
P2a
P3a
P4a
W1
W2
1
2
2a
2b
2'
3
4
5
17A
12A
17B
12B
17C
12C
17D
12D
16A
16B
16C
16D
Ls
Lp
15A
15B
15C
15D
10
11A
11B
11C
11D
13A
13B
13C
13D
14A
14B
14C
14D
FROM D
FROM 8A
FROM 8B
FROM 8C
FROM 8D
TO 7
TO 7
TO 24

SYSTEM FOR FORCEFULLY IGNITING SPRAYED FUEL OF A DIESEL ENGINE DURING ENGINE STARTING

BACKGROUND OF THE INVENTION

1. Field of the Invention

The present invention relates to a system for forcefully igniting sprayed fuel of a diesel engine, more particularly, to an ignition system for starting a diesel engine with an engine starter motor by forcefully burning sprayed fuel oil, at least until the sprayed fuel becomes spontaneously ignitable.

2. Description of the Prior Art

In a diesel engine, particularly in a diesel engine of the type having subcombustion chambers such as a swirl chambers or a precombustion chambers, each glow plug is provided within a corresponding subcombustion chamber. The glow plugs act as means for heating the subcombustion chambers before the engine starter motor is actuated so as to ignite a spray of fuel oil injected and mixed with compressed air in the subcombustion chambers. The glow plugs start the diesel engine in conjunction with the starter motor by igniting a spray of fuel injected through a fuel injection valve. The injected fuel is brought into contact with the surface of the corresponding glow plug which is heated by heavy current flowing therethrough. When the engine needs to be started at a low ambient temperature, e.g., at an air temperature of minus 25° C., each glow plug requires a continuous heavy current of about 8 amperes (12V×8A) for 30 to 60 seconds before the diesel engine can be started by means of the engine starter motor so as to activate the engine into a spontaneous fuel ignition state.

In this way, the conventional auxiliary engine starting system for a diesel engine requires a preheating operation in which a large current is sent through each glow plug before the engine starter motor is actuated.

Therefore, the engine starting procedure is complicated and it takes a long time for the engine to reach in the spontaneous fuel ignition state. In addition, a great quantity of electrical power is consumed in order to heat the glow plugs so that the load on the DC power supply (battery) is increased and accordingly fuel consumption is increased. On the other hand, if the ignition operation stops immediately after the engine enters in the spontaneous ignition state, the engine will not revolve smoothly so that irregular vibrations may occur.

SUMMARY OF THE INVENTION

With the above-described problems in mind, it is an object of the present invention to provide a new auxiliary engine starting system for a diesel engine in place of a conventional glow plug preheat system to reduce electrical power consumption and accordingly to achieve better fuel economy. It is another object of the present invention to provide a new auxiliary engine starting system for a diesel engine which facilitates engine start-up. It is still another object of the present invention to provide a new auxiliary starting system for a diesel engine which starts an ignition operation when the engine starter motor is actuated and stops after a predetermined period of time or when a particular engine operating condition is satisfied indicating that the engine has started to operate in a spontaneous ignition state so as to permit smooth engine rotation. It is still another object of the present invention to provide a new auxiliary engine starting system for a diesel engine which can assure the ignition of the sprayed fuel in a subcombustion chamber when the engine is started at an extremely low ambient temperature.

This can be achieved by providing an ignition system which comprises: a spark plug within each subcombustion chamber; a high-voltage charging means; an ignition control means which controls an ignition timing at which the high-voltage charging means applies a high voltage to each spark plug so as to generate a spark discharge thereat; a first decision means which decides to send a low DC voltage to the ignition control circuit according to an engine operating condition so as to start the ignition operation in response to the actuation of an engine starter motor; and a second decision means which decides to interrupt the low DC voltage supply to the ignition control means so as to stop the forced ignition of injected fuel by means of the spark discharge at the corresponding spark plug according to an engine operating condition, whereby the ignition operation by means of the high-voltage charging means and ignition control means is carried out at least until the engine fuel mixed with compressed high-temperature air becomes spontaneously ignitable.

BRIEF DESCRIPTION OF THE DRAWINGS

The features and advantages of the present invention will be appreciated from the foregoing description and attached drawings in which like reference numerals designate corresponding elements and in which.

DETAILED DESCRIPTION OF THE PREFERRED EMBODIMENTS

Reference will, hereinafter, be made to the drawings in order to facilitate understanding of the present invention.

Figure 1:
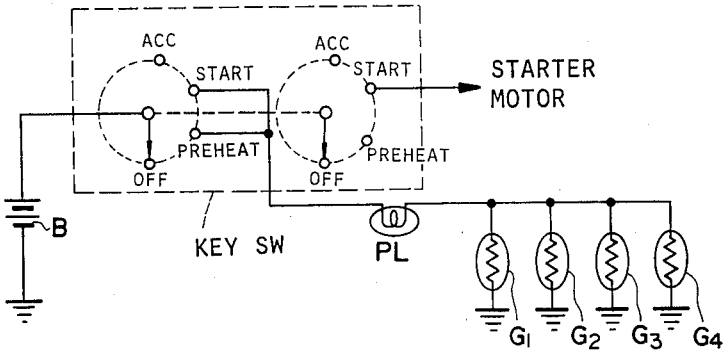
FIG.1 PRIOR ART
FIG. 1 is a simplified circuit diagam showing a conventional engine starting auxiliary system for a fourcylinder diesel engine using glow plugs.
Figure 2:
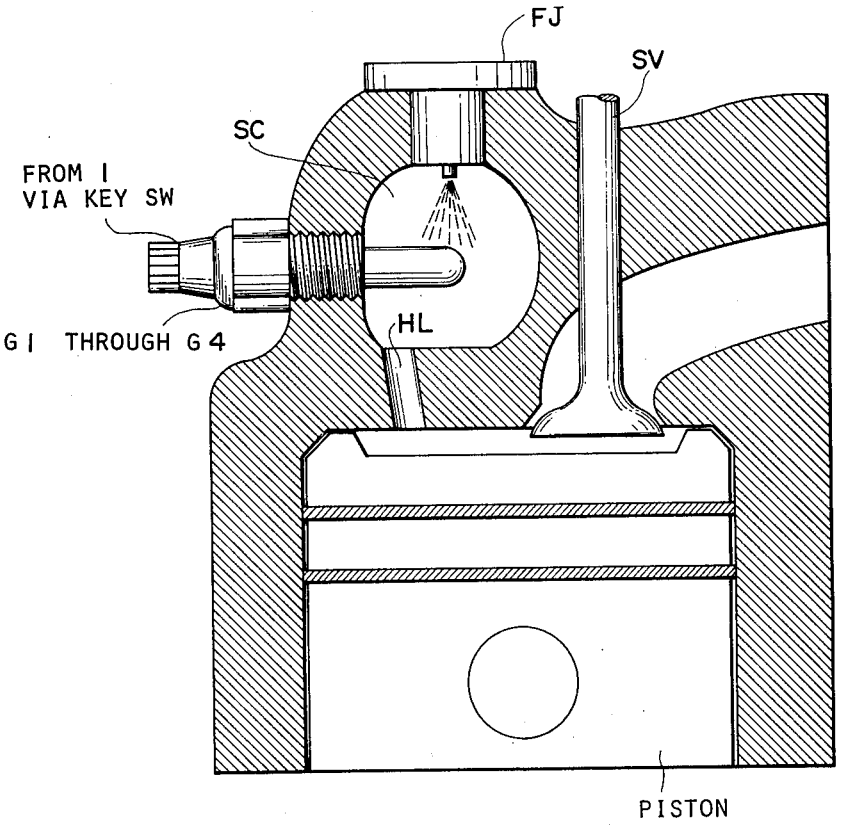
FIG.2 PRIOR ART
FIG. 2 is a cross-sectional view of a typical diesel engine cylinder of the swirl-chamber type wherein a glow plug shown in FIG. 1 is incorporated into the swirl chamber.

First in FIG. 1, showing a conventional auxiliary engine starting system for a diesel engine particularly applied to a four-cylinder diesel engine, four glow plugs $G_1$ through $G_4$ are connected in parallel with each other to a PREHEAT position of a double-pole rotary key switch KEY SW via a plot lamp PL. An engine starter motor is connected to a START position of the double-pole rotary key switch KEY SW. When the key switch KEY SW is transferred from an OFF position to the PREHEAT position, the pilot lamp PL is lighted and the glow plugs $G_1$ through $G_4$ start to glow due to current flow from a battery B via the key switch KEY SW and the lamp PL. After several tens of of waiting for sufficient warming up of the glow plugs $G_1$ through $G_4$, the key switch KEY SW is moved to the START position so that the starter motor is actuated. At the end of each compression stroke of each cylinder, a certain amount of fuel is injected through a fuel injection value FJ into the swirl chamber SC, shown in FIG. 2, so as to bring a spray of injected fuel into contact with the surface of the corresponding glow plug $G_1$ through $G_4$ installed in the swirl chamber SC. Therefore, the injected fuel is ignited and the ignited fuel rushes into a main combustion chamber via an injection hole HL.

Figure 3A:
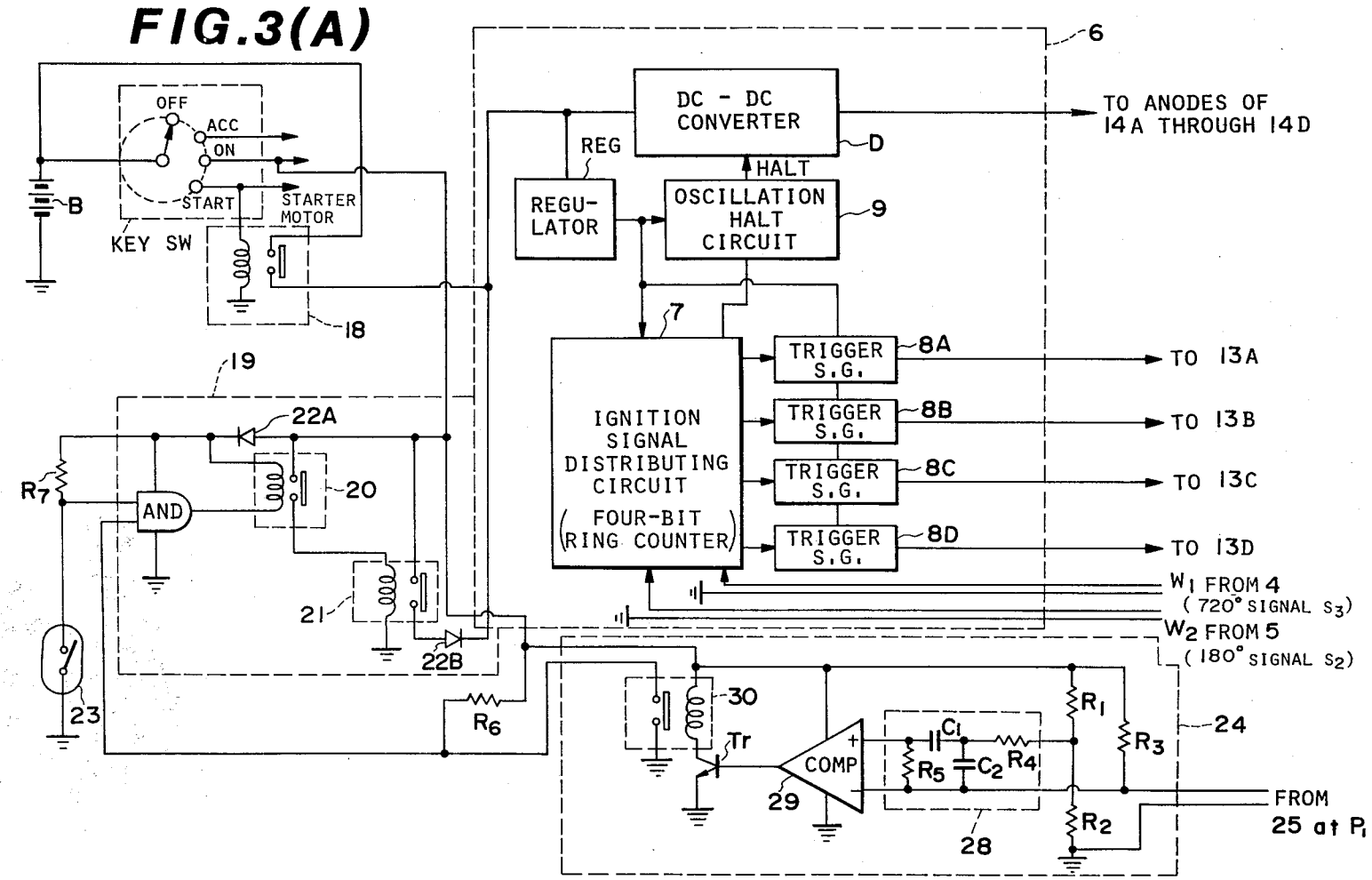
FIG. 3(A) and 3(B) are simplified circuit diagrams integrally showing a first preferred embodiment according to the present invention.
Figure 3:
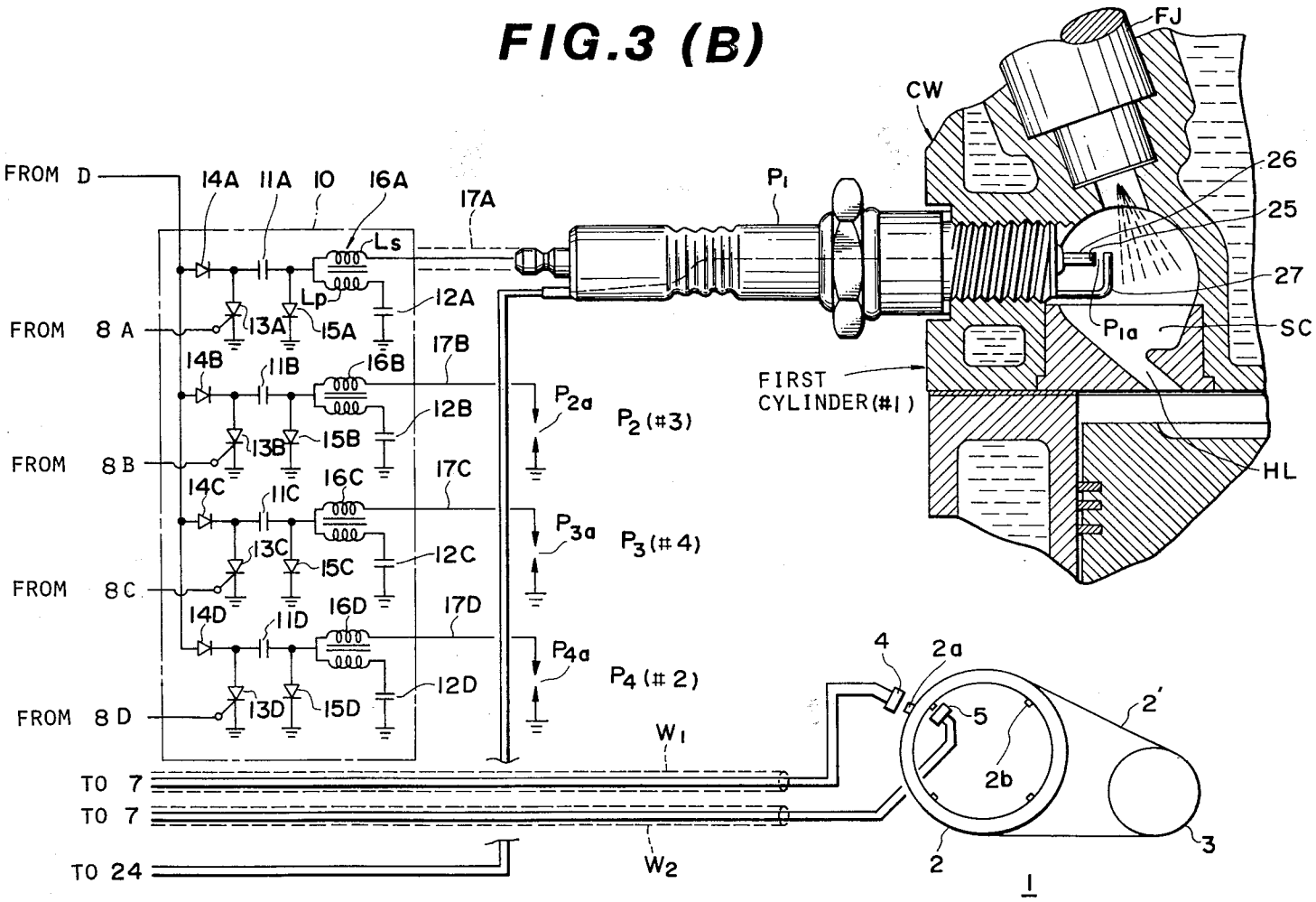

FIGS. 3(A) and 3(B) in combination show a first preferred embodiment according to the present invention, particularly applicable to a four-cylinder diesel engine.

In FIGS. 3(A) and 3(B), each spark plug $P_1$ through $P_4$ is provided within a subcombustion chamber, e.g., swirl chamber SC, of a corresponding engine cylinder in such a way that a spark discharge gap $P_{1a}$ through $P_{4a}$ is located within the swirl chamber SC together with the corresponding injection valve FJ and a screw portion thereof is fitted into a cylinder wall CW. Each spark plug $P_1$ through $P_4$ may be either an ordinary spark plug or a plasma spark plug generating a creeping discharge. A first spark plug $P_1$ is installed in a first engine cylinder (#1), second spark plug $P_2$ in a third cylinder (#3), third spark plug $P_3$ in fourth cylinder (#4), and fourth spark plug $P_4$ in a second cylinder (#2) in accordance with the ignition order of the four cylinder engine.

Numeral 1 denotes a crank angle sensor which comprises: (a) a timing disc 2 linked with a crank pulley 3 by means of a belt 2' which rotates half as fast as the crank pulley 3; (b) a first pulse generator 4 (electro-magnetic pick-up), located so as to face the disc 2, which generates a 720° signal indicating that the engine has rotated through two revolutions (one engine cycle) whenever a projection 2*a* extending from the peripheral surface of the disc 2 passes therethrough; and (c) a second pulse generator 5, located so as to face the disc 2, which generates a 180° signal indicating the engine has rotated through half a revolution (i.e., 180°) whenever one of the projections 2*b* extending from the internal peripheral surface of the disc 2 passes therethrough. The period of the signal generated by the second pulse generator depends on the number of engine cylinders. These first and second pulse generators 4 and 5 output the 720° and 180° signals to an ignition control circuit 6 via shielded double-core cables $W_1$, $W_2$, respectively. The 180° signal may alternatively be obtained by a pressure transducer which electrically detects the pressure within a fuel feed pipe extending into each of the fuel injection valves FJ, or from the lift operation of a needle valve portion of each fuel injection valve FJ by means of, e.g., a photo-coupler.

The ignition control circuitry 6 comprises: (a) a DC-DC converter D which boosts a low DC voltage, e.g., 12 volts supplied from the battery B to several hundred kilovolts; (b) a voltage regulator REG which regulates the DC voltage from the battery B to produce a regulated DC voltage (e.g., 8 volts); (c) an ignition signal distributing circuit 7, e.g., four-bit ring counter biased by the voltage regulator REG; (d) trigger signal generators, e.g., monostable multivibrators 8A through 8D; and (e) an oscillation half command signal generator 9, e.g., another monostable multivibrator.

The detailed structure and operation of the ignition control circuit 6 are to be described hereinafter. The ignition signal distributing circuit 7 receives the 180° signal from the second pulse generator 5 and the 720° signal from the first pulse generator 4. The 720° signal is used to reset the ignition signal distributing circuit 7.

The oscillation halt command signal generator 9 outputs another pulse signal to the DC-DC converter D having a predetermined pulsewidth (e.g., 1 millisecond) at the HALT terminal thereof whenever the 180° signal is received through the ring counter 7 for halting the output of the high DC voltage.

A high-voltage generating circuit 10 comprises: (a) four first capacitors 11A through 11D; (b) four second capacitors 12A through 12D; (c) four thyristors 13A through 13D; (d) four first diodes 14A through 14D; (e) four second diodes 15A through 15D and; (f) four voltage boosting transformers 16A through 16D. One of each of the first capacitor, second capacitor, thyristor, first and second diode are provided for the corresponding engine cylinder. The anodes of the first diodes 14A through 14D are connected to the output terminal of the DC-DC converter D and the cathodes thereof are connected to the left end of the corresponding first capacitor 11A through 11D and to the corresponding anode of the thyristors 13A through 13D. A right end of each first capacitor 11A through 11D is grounded via the corresponding second diode 15A through 15D and is connected to a common end of primary and secondary windings Lp and Ls of the corresponding transformer 16A through 16D. Each other end of the primary windings Lp of the transformer 16A through 16D is grounded via the corresponding second capacitor 12A through 12D. The cathodes of the thyristors 13A through 13D are grounded. Each other end of the secondary windings Ls of the transformers 16A through 16D is connected to the corresponding spark plug $P_1$ through $P_4$ via a corresponding high-tension cable 17A through 17D. The high-tension cables 17A through 17D are so constructed as to prevent high-frequency noise from radiating externally therefrom.

For example, when the first thyristor 13A receives no trigger signal from the corresponding trigger signal generator 8A, a boosted high DC voltage from the DC-DC converter D is charged within the corresponding first capacitor 11A via the corresponding first diode 14A with the right end of the first capacitor 11A grounded via the corresponding second diode 15A, since the first thyristor 13A is turned off at this time and the potential across the second diode 15A causes this diode to be forward biased. Next when the first thyristor 13A receives the trigger signal, the thyristor 13A turns on so that the left end of the first capacitor 11A is grounded and the right end thereof floats with respect to ground. At this time, the charged high DC voltage of the first capacitor 11A is applied across the primary winding Lp and second capacitor 12A (the capacitance of the second capacitor 12A through 12D is lower than that of the first capacitor 11A through 11D) and a damped oscillation occurs thereat. Since the winding ratio of the secondary and primary windings Ls and Lp is N:1 ($N>1$), the voltage applied at the primary winding Lp of the transformer 16A is boosted and then supplied to the spark plug $P_1$. When the second capacitor 12A is fully charged, the remaining electric charge within the first capacitor 11A is discharged through the spark discharge gap $P_{1a}$ of the spark plug $P_1$, the resistance of the discharge gap $P_{1a}$ being reduced to a minimum by the spark discharge from the first capacitor 11A.

It should be noted that while the first capacitor 11A is discharged through the corresponding thyristor 13A, the DC-DC converter D receives an oscillation halt command signal of a predetermined pulsewidth from the oscillation halt circuit 9 at the halt terminal thereof so that the output of the boosted high DC voltage is halted. Consequently, the corresponding thyristor 13A turns off automatically. The oscillation halt circuit 9 comprises a monostable multivibrator which responds to the 180° signal from the second pulse generator 5.

Numeral 18 denotes a first electromagnetic relay which is energized when the key switch KEY SW is placed at the START position for actuating an engine starter motor (not shown). As long as the first relay 18 is energized, the low DC voltage is supplied to the ignition control circuit 6. Numeral 19 denotes an ignition system stop decision circuit provided for continuously activating the entire ignition system during the period from when the engine starter motor is turned off until the spontaneous ignition state of the engine is achieved. The ignition system stop decision circuit 19 comprises: (a) an AND gate circuit AND; (b) second and third relays 20 and 21; and (c) third and fourth diodes 22A and 22B.

Input signals of the ignition system stop decision circuit 19 may be derived from a single or various sensors which detect the fuel combustion state of the engine from representative factors such as cooling water temperature, combustion chamber temperature, and exhaust gas temperature, etc. In this embodiment, as shown in FIGS. 3(A) and 3(B), the combination of a cooling water temperature sensor 23 and a combustion chamber temperature sensor 24 is used. The cooling water temperature sensor 23 is so constructed as to close when the engine cooling water temperature decreases below a predetermined value.

As shown in FIG. 3(B), a temperature sensitive element (e.g., thermocouple) 25 is incorporated to a central electrode 26 of the spark plug $P_1$ for detecting the temperature of a combustion chamber, such as swirl chamber SC. The temperature sensitive element 25 may alternatively be attached to a wall of the subcombustion chamber. An internal circuit of the combustion chamber temperture sensor 24 comprises: (a) a filter circuit 28 which eliminates high-frequency ignition noise generated by the spark plug $P_1$; (b) a comparator 29 which compares the voltage inputted from the temperature sensitive element 25 filtered by the filter circuit 28 with a reference voltage divided by resistors $R_1$ and $R_2$; (c) a transistor Tr, the base of which is connected to an output terminal of the comparator 29, and so which turns on when the comparator 29 outputs a high-level voltage signal indicating that the combustion chamber temperature exceeds the predetermined value; and (d) a fourth relay 30 which opens a contact thereof when the transistor Tr turns on.

The AND gate circuit AND receives two signals from the cooling water temperature sensor 23 and combustion chamber temperature sensor 24 so as to output a high-level voltage signal (corresponding to a logic "1") only when high-level voltage signals are received simultaneously from the two sensors 23 and 24.

Figure 4:
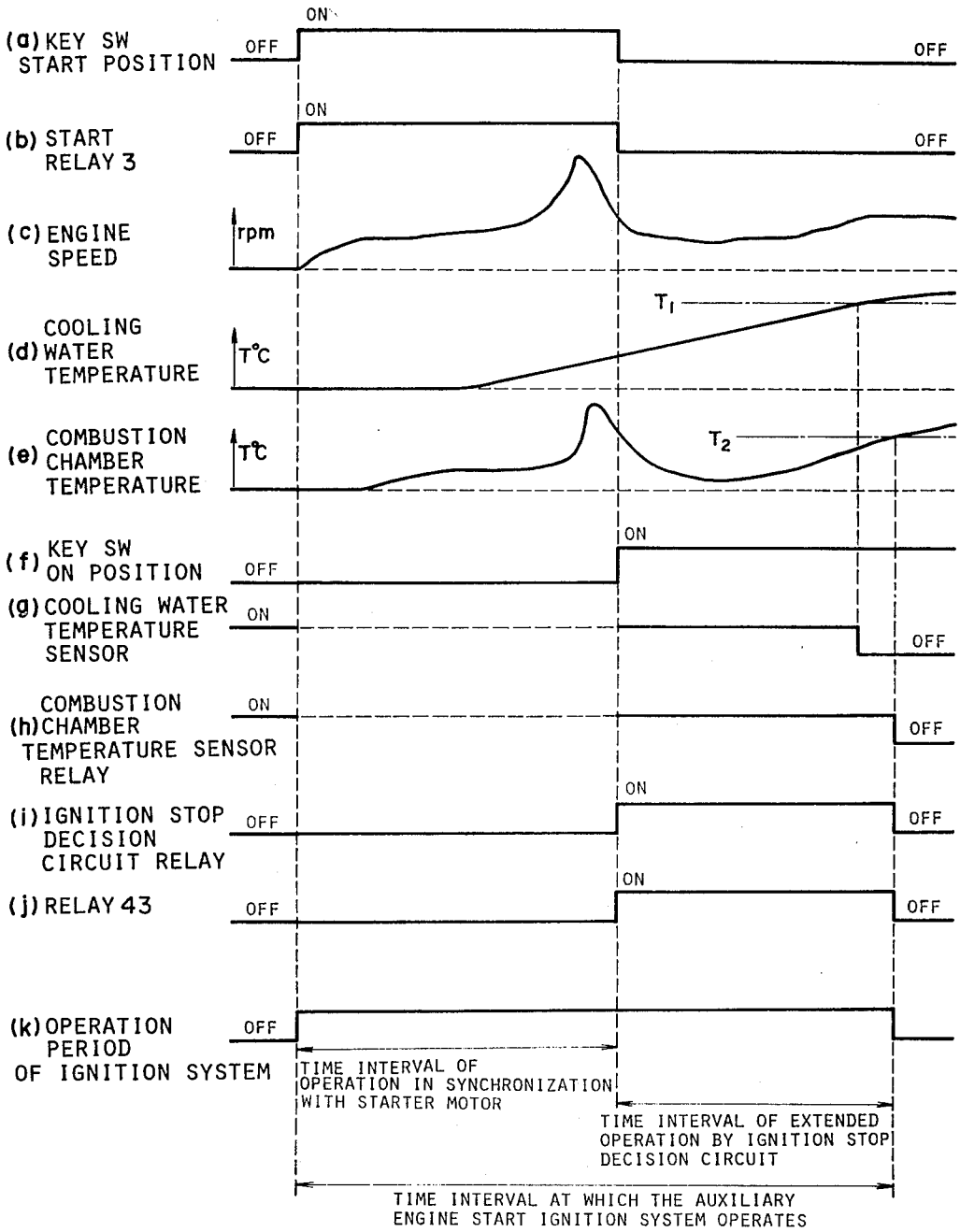
FIG. 4 is a signal timing chart showing the signal timing relationships between some output signals of the auxiliary engine starting system shown in FIGS. 3(A) and 3(B)

FIG. 4 shows an operation timing chart of the circuit described above.

When the key switch KEY SW is moved to the START position as shown in (a) of FIG. 4, the first relay 18 is energized and the contact thereof is closed as shown in (b) of FIG. 4 simultaneously with the actuation of the starter motor. Consequently, the low DC voltage is supplied from the battery B to the ignition control circuit 6. Thereafter the ignition control circuit 6 and high-voltage generating circuit 10 are operated so that the spark discharge gap of each spark plug $P_1$ through $P_4$ generates a spark discharge to facilitate ignition of a spray of injected fuel whenever a given amount of fuel is injected through the injection valve FJ into the swirl chamber SC.

When the engine operator recognizes that the engine has acheived the spontaneous ignition state due to an abrupt increase of the engine revolutional speed and returns the key switch KEY SW to the ON position, the engine starter motor is stopped and simultaneously the contact of the first relay 18 is opened. However, until both engine cooling water temperature and combustion chamber temperature reach the respective predetermined values, the output voltage level of the AND gate circuit AND remains low so that both second and third relays 20 and 21 remain closed. Therefore, after the key switch KEY SW is returned to the ON position, the low DC voltage is continuously supplied from the battery B into the ignition control circuit 6 via the third relay 21 and fourth diode 22B. Consequently, the auxiliary engine starting system will operate continuously until the engine achieves the spontaneous fuel ignition state. The engine has achieved the spontaneous ignition state when both the cooling water temperature and combustion chamber temperature increases and reach the respective predetermined values $T_1$ and $T_2$ as shown in (d) and (e) of FIG. 4. The cooling water temperature sensor 23 detects that the cooling water temperature exceeds the predetermined value $T_1$ and turns off. At substantially the same time when the cooling water temperature sensor turns off, the fourth relay 30 also turns off. Therefore, the AND gate circuit AND outputs a logic "1" signal when the two sensor signals agree so that second and third relays 20 and 21 are turned off to stop the overall auxiliary engine start ignition system. Therefore, the interval of time during which the ignition system can operate is the sum of the operation time interval for which the engine is started by the starting motor and that required for the engine to achieve the spontaneous ignition state. The transition of the engine operation from cranking to the spontaneous ignition state can be made without failure.

Figure 5A:
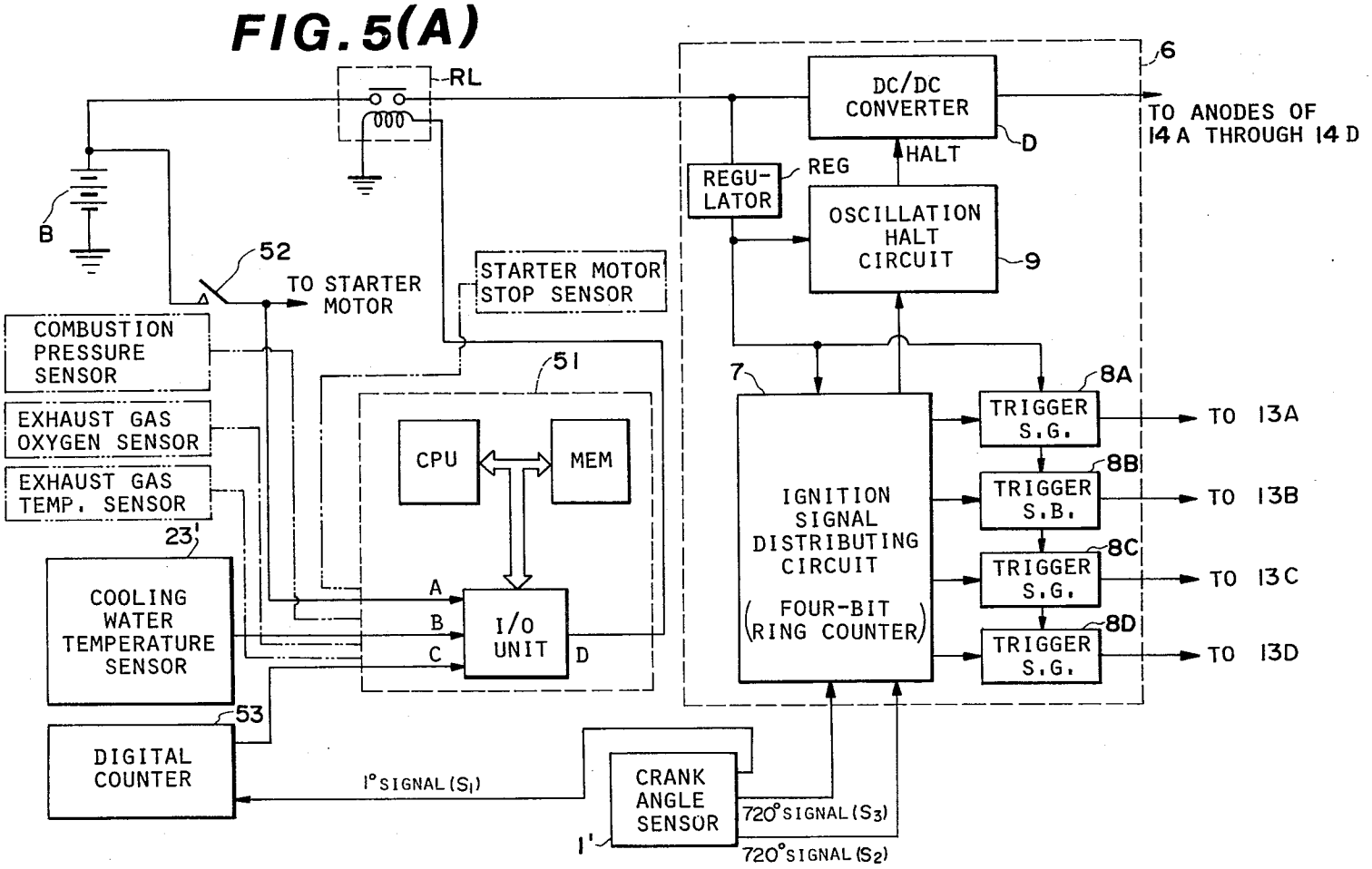
FIG. 5(A) and 5(B) are simplified circuit diagrams integrally showing a second preferred embodiment according to the present invention.
Figure 5B:
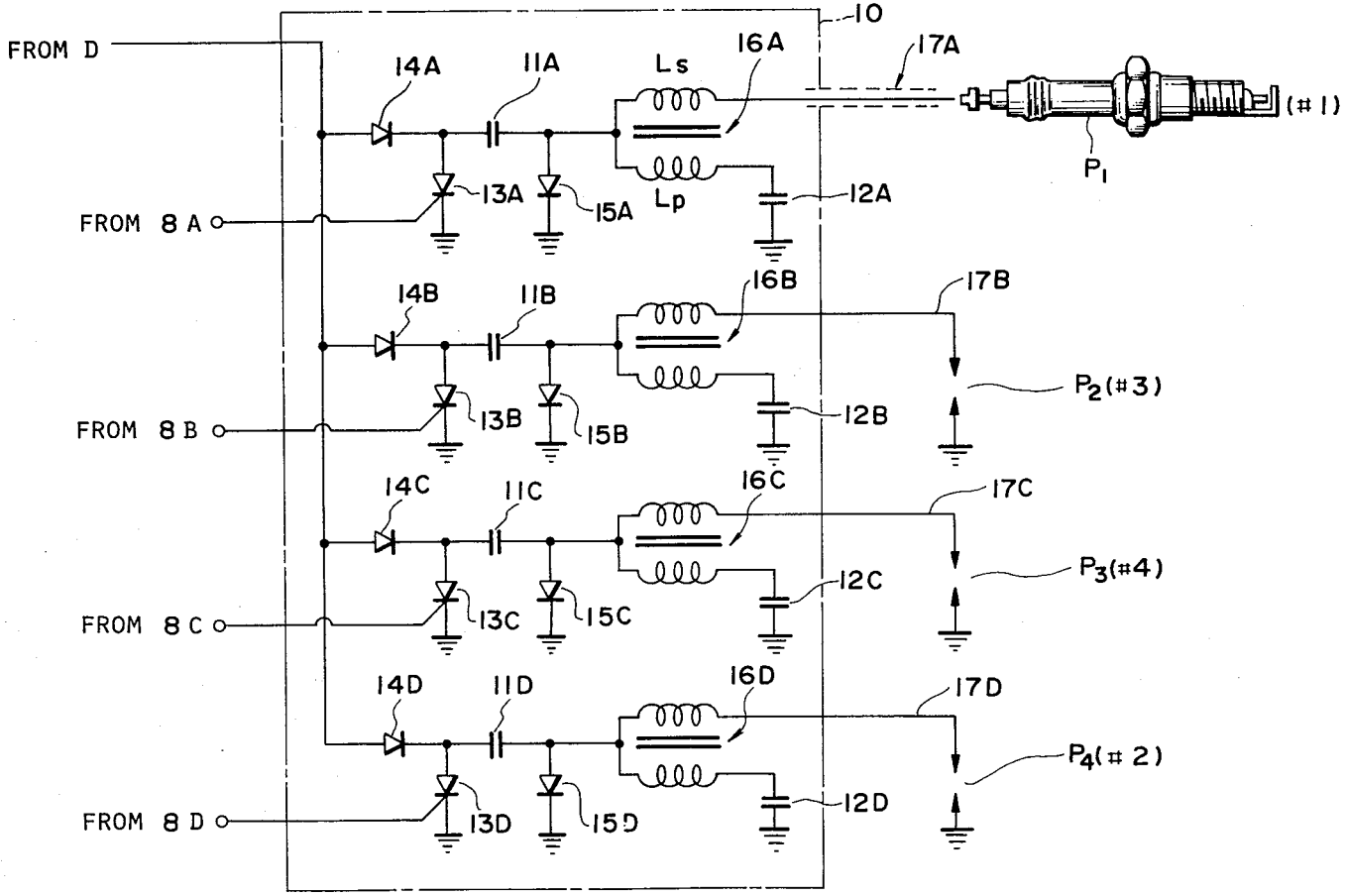

FIGS. 5(A) and 5(B) show a second preferred embodiment according to the present invention.

Figure 6:
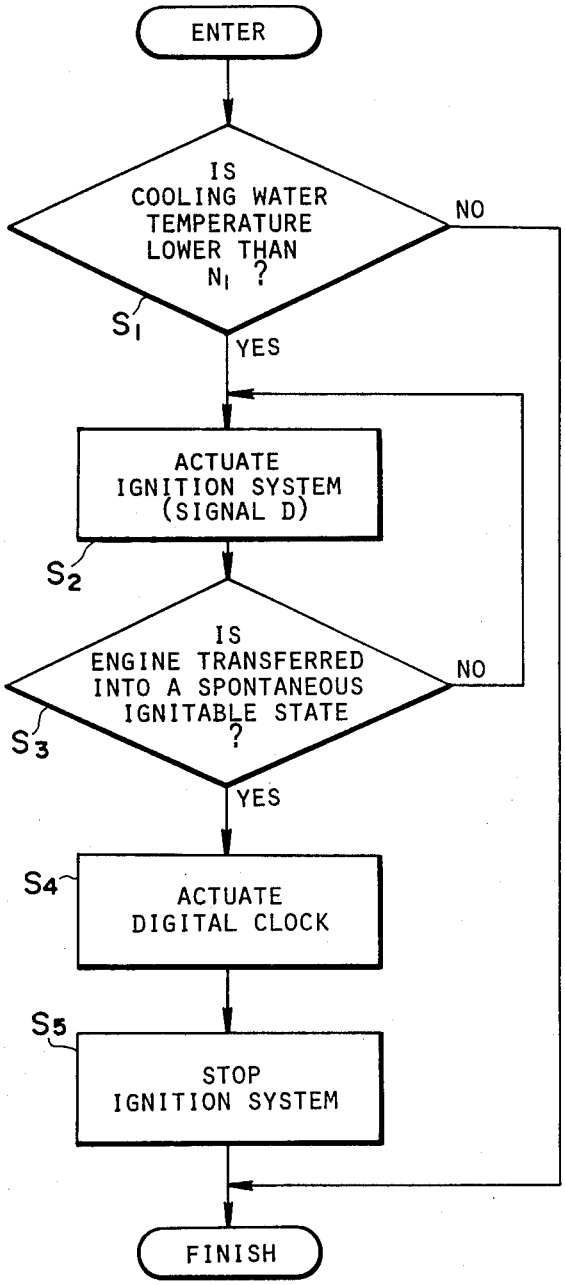
FIG. 6 is a flowchart showing a routine which a microcomputer shown in FIG. 5(A) executes to actuate and stop the auxiliary engine starting system shown in FIGS. 5(A) and 5(B) according to engine operating conditions.
Figure 7:
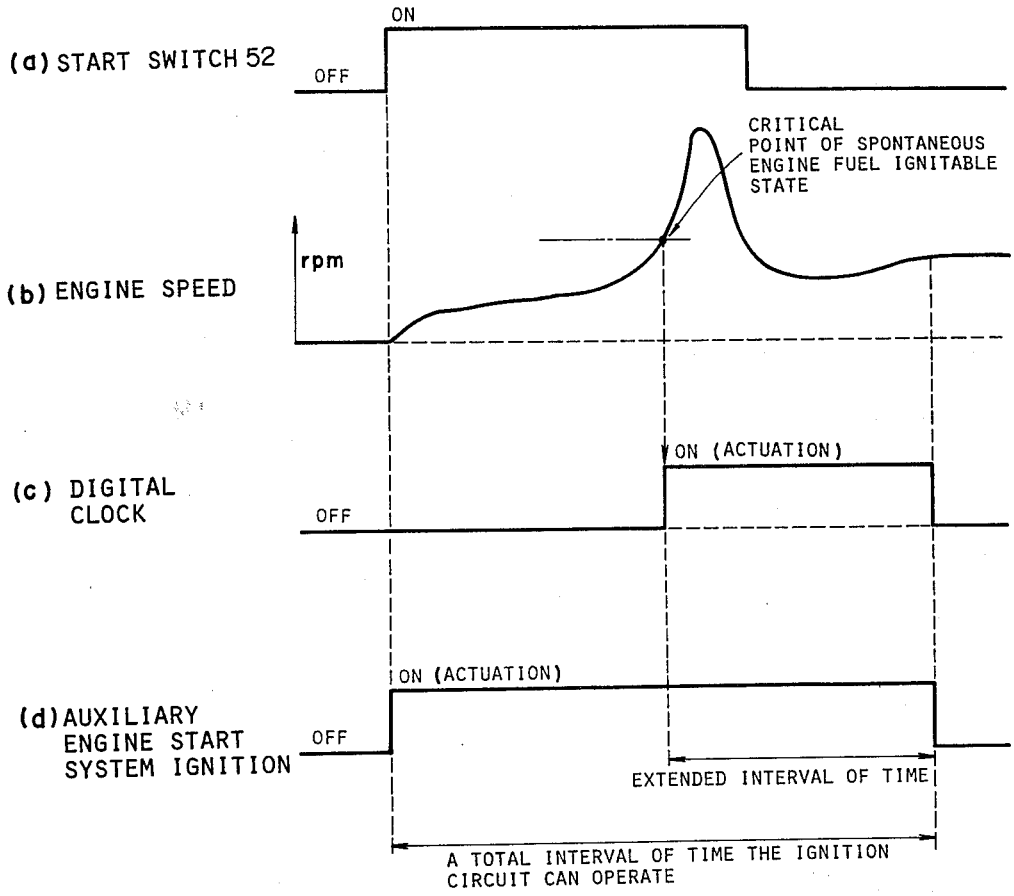
FIG. 7 is a signal timing chart showing the signal timing relationships between some representative output signal of the auxiliary engine starting system shown in FIG. 6.

In this embodiment, an ignition circuit actuation circuit 51 is provided which comprises a microcomputer having a Central Processing Unit (CPU), a Memory (MEM), and I/O unit. The ignition circuit actuation circuit 51 is started when a start switch 52 (corresponding to the START position of the key switch KEY SW shown in FIG. 3(A) is turned on and, as shown by the flowchart of FIG. 6, in a step $S_1$ the actuation circuit 11 decides to supply the low DC voltage from the battery B to the ignition control circuitry 6 for actuating the DC-DC converter D and regulator REG depending upon whether or not the engine cooling water temperature equals or exceeds a predetermined value $N_1$. If the cooling water temperature as measured by the cooling water temperature sensor 23' is lower than the predetermined value $N_1$ (e.g., 15°), the actuation circuit 51 advances to the subsequent step $S_2$ in which a control signal D with a high-level voltage (logic "1") is sent to an electromagnetic relay RL to close a contact thereof simultaneously with the actuation of the engine starter motor (not shown). The contact of the relay RL is connected between the battery B and ignition control circuit 6. In subsequent step $S_3$, the actuation circuit 51 detects whether the engine has achieved the spontaneous fuel ignition state. For example, the number of 1° signals fed from the crank angle sensor 1' is counted by a digital counter 53 to detect the number of engine revolutions for each predetermined period of time, e.g., one minute. Each pulse of the 1° signal described above corresponds to one degree of the crankshaft revolution angle. Therefore, the crank angle sensor 1' must have other projections on the disc 2 and a pulse signal generator for generating the 1° signal. When the number of the 1° signals reaches a predetermined number, corresponding to 1500 rpm, for example, the actuation circuit 51 judges that the engine has achieved the spontaneous fuel ignition state, as shown in the timing chart of FIG. 7. Upon detection of the spontaneous ignition state of the engine in the step $S_3$, the actuation circuit 11 actuates a built-in digital clock to begin measuring the elasped time in the subsequent step $S_4$. After a predetermined time has passed, the control signal D is returned to the low level in a step $S_5$ so that the relay RL is turned off to disable the supply of the low DC voltage to the ignition control circuitry 6. The predetermined time of the digital clock is long enough to allow the engine to attain a completely stable spontaneous fuel ignition state even when the engine is started at a cold ambient temperature, e.g., at an ambient temperature below minus 25° C. It should be noted that in this case the engine operator may turn off the starter motor at any time after the engine has achieved the spontaneous fuel ignition state.

In this embodiment shown in FIGS. 5(A), 5(B), 6, and 7, the detection of the spontaneous fuel ignition state is based on the current number of engine revolutions per minute, for example, which exceeds the predetermined value as detected by means of the digital counter 53. An oxygen sensor may alternatively be used to detect the oxygen concentration in exhaust gas from the engine. In other words, the oxygen sensor is used to inform the actuation circuit 51 of the engine fuel ignition state by detecting whether the oxygen concentration in exhaust gas exceeds a predetermined value. A combustion pressure sensor may alternatively be used to inform the actuation circuit 51 of the engine fuel spontaneous ignition state by detecting whether the combustion chamber pressure exceeds a predetermined value sufficient for the fuel to ignite spontaneously. Furthermore, an exhaust gas temperature sensor may alternatively be used to inform the actuation circuit 51 of the engine fuel spontaneous ignition state by detecting whether the exhaust gas temperature exceeds a predetermined value, e.g., 500° C. through 600° C., or an engine starter motor stop detection circuit may alternatively be used which detects whether the starter motor has stopped. If the latter detecting means is used, the predetermined period of time measured by the digital clock should be longer than in the other cases described hereinabove. The engine cooling water temperature sensor 23' may also be used to inform the actuation circuit 51 of the engine fuel spontaneous ignition state by detecting whether the cooling water temperature exceeds another predetermined value $N_2$, e.g., 40° C. As an alternative to the cooling water temperature sensor 23' a lubricating oil temperature may serve as a means for deciding to enable operation of the entire ignition circuit.

As described hereinabove, the auxiliary engine start ignition system according to the present invention which can start the diesel engine immediately when an ignition key switch is moved to the START position simultaneously with actuation of an engine starter motor and can prolong forced ignition of injected fuel at least until the engine has achieved a completely spontaneous fuel ignition state according to whether the engine speed exceeds a predetermined value, whether the engine cooling water temperature exceeds a predetermined value, or whether the oxygen concentration in exhaust gases exceeds a predetermined value, etc. Consequently, the transition into the spontaneous ignition state can be performed smoothly regardless of the engine ambient temperature simply by turning the ignition key switch to the START position and thereafter returning it to the ON position.

It will fully be understood by those skilled in the art that various changes and modifications may be made without departing from the spirit and scope of the present invention, which is to be defined by the appended claims.

What is claimed is:

1. An ignition system for subsidiarily starting a multicylinder diesel engine having a low DC voltage supply and a starter motor, comprising:

(a) a plurality of spark plugs, each installed within a corresponding cylinder so as to expose a discharge gap thereof to injected fuel from a corresponding fuel injection valve;

(b) an ignition signal generating means which generates and outputs a first pulse signal whenever the engine has rotated through two revolutions and generates and outputs a second pulse signal whenever the engine has rotated through an angle predetermined in accordance with the number of engine cylinders;

(c) an ignition control means which converts a low DC voltage from the low DC voltage supply to a high DC voltage said ignition control means being actuated in response to the actuation of the engine starter motor;

(d) an ignition energy charging means responsive to the first and second pulse signals for distributing the energy derived from the high DC voltage from said ignition control means to each of said spark plugs sequentially; and (e) a spontaneous ignition state detecting means which detects whether measurable engine operating conditions indicate that a spray of fuel injected into each engine cylinder is spontaneously ignitable and outputs a stop signal to said ignition control means for interrupting the supply of the low DC voltage from said low DC voltage supply to said ignition control means when the spontaneous ignition state is detected.

2. An ignition system as set forth in claim 1, wherein said spontaneous ignition state detecting means comprises an engine speed detecting means which measures engine speed and outputs the stop signal when the engine speed exceeds a predetermined value.

3. An ignition system as set forth in claim 1, wherein said spontaneous ignition state detecting means comprises a combustion pressure detecting means having a pressure sensitive element located at one of the spark plugs which measures combustion pressure within the corresponding combustion chamber and outputs a stop signal when the combustion pressure exceeds a predetermined value.

4. An ignition system as set forth in claim 1, wherein said spontaneous ignition state detecting means comprises an oxygen concentration detecting means having an oxygen sensor located within an exhaust pipe of the engine which measures the concentration of oxygen in exhaust gas and outputs a stop signal when the concentration of oxygen exceeds a predetermined value.

5. An ignition system as set forth in claim 1, wherein said spontaneous ignition state detecting means comprises an engine starting motor stop detecting means which detects whether the engine starter motor is stopped, and outputs a stop signal when the starter motor is stopped.

6. An ignition system as set forth in claim 1, wherein said spontaneous ignition state detecting means comprises an exhaust gas temperature detecting means which measures the exhaust gas temperature of the engine and outputs a stop signal when the exhaust gas temperature exceeds a predetermined value.

7. An ignition system as set forth in claim 1, wherein said spontaneous ignition state detecting means comprises an engine cooling water temperature sensor which detects an engine cooling water temperature and outputs the stop signal when the engine cooling water temperature exceeds a predetermined value.

8. An ignition as set forth in any one of claims 3 through 7, further comprising a clock timer for delaying the output of the stop signal for a predetermined period of time.

9. An ignition sytem as set forth in any one of claims 1 through 6, which further comprises a ignition system start decision means which allows transmission of the low DC voltage from the low DC voltage supply to said ignition control means when engine cooling water temperature is below a first predetermined value.

10. An engine auxiliary start system for a diesel engine, comprising:

(a) a first means, having a plurality of spark plugs each installed within a corresponding combustion chamber, for igniting fuel injected into the corresponding combustion chamber by means of spark discharge;

(b) a second means for actuating said first means in synchronization with the actuation of an engine starter motor;

(c) a third means for detecting the combustion state of the diesel engine and outputting a signal while the combustion state is such that fuel injected into the engine cylinders will not be ignited with the spark discharge from said first means; and (d) a fourth means for continuously actuating said first means in response to the output signal from said third means for a fixed period of time after the starter motor is stopped until the engine achieves a spontaneous ignition state in which fuel injected into the engine cylinders can be ignited in the absence of the spark discharge from said first means.

11. An ignition system as set forth in claim 10, wherein said third means comprises a temperature sensing means for detecting one of engine cooling water temperature, combustion chamber temperature, and exhaust gas temperature, and which outputs the signal so as to stop said first means when the corresponding temperature exceeds a predetermined value.

12. A system for forcefully igniting a spray of fuel injected into a diesel engine, which comprises:

(a) a plurality of spark plugs, each located within a corresponding engine cylinder;

(b) an ignition means for igniting each of said spark plugs sequentially according to a predetermined ignition order when an engine starter motor is actuated;

(c) detection means for detecting and signalling that the diesel engine has reached a state in which a spray of fuel injected into the diesel engine can ignite and burn spontaneously; and (d) determination means for determining a stopping point of said ignition means at a fixed time interval after said detection means detects that the diesel engine has reached said state.

13. The system as set forth in claim 12, wherein said determination means measures said fixed interval of time by means of a clock timer means.

14. The system as set forth in claim 12, wherein said determination means measures said fixed interval of time depending on whether an engine cooling water temperature increases and reaches a predetermined value.

* * * * *